US011221640B2

(12) United States Patent
Muranaka et al.

(10) Patent No.: US 11,221,640 B2
(45) Date of Patent: Jan. 11, 2022

(54) MULTIDIRECTIONAL INPUT DEVICE

(71) Applicant: ALPS ALPINE CO., LTD., Tokyo (JP)

(72) Inventors: Tetsuo Muranaka, Miyagi (JP); Kunio Hosono, Fukushima (JP); Sadayuki Yaginuma, Miyagi (JP); Yasuji Hagiwara, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/323,248

(22) Filed: May 18, 2021

(65) Prior Publication Data

US 2021/0271283 A1 Sep. 2, 2021

Related U.S. Application Data

(63) Continuation of application No. 17/102,626, filed on Nov. 24, 2020, now Pat. No. 11,042,179.

(30) Foreign Application Priority Data

Dec. 17, 2019 (JP) ..... JP2019-227697

(51) Int. Cl.
*G05G 1/04* (2006.01)
*G05G 23/02* (2006.01)
(Continued)

(52) U.S. Cl.
CPC ..... *G05G 1/04* (2013.01); *G05G 5/005* (2013.01); *G05G 5/05* (2013.01); *G05G 23/02* (2013.01)

(58) Field of Classification Search
CPC ..... G05G 1/02; G05G 1/025; G05G 1/04; G05G 1/06; G05G 1/10; G05G 1/12; G05G 5/05; G05G 9/047; G05G 2009/04703; G05G 2009/0474; G05G 2009/04744; G05G 2009/04748; G05G 2009/04755;
(Continued)

(56) References Cited

U.S. PATENT DOCUMENTS 9,134,187 B1 9/2015 Organ et al.
10,770,247 B1 9/2020 Wu
(Continued)

FOREIGN PATENT DOCUMENTS

JP 2000-250649 9/2000
JP 2018-200854 12/2018

*Primary Examiner* — Richard W Ridley
*Assistant Examiner* — Brian J Mcgovern
(74) *Attorney, Agent, or Firm* — IPUSA, PLLC

(57) ABSTRACT

A multidirectional input device includes a frame, a plate-shaped base below the frame, a load detector provided on the frame or the base, and circuitry. The frame stores part of a tiltable operation stick and a tilt detector. The circuitry is configured to output an output signal representing the direction and the magnitude of an operation on the operation stick, based on the angle detection value of the tilt of the operation stick detected by the tilt detector and the load detection value of a load applied to the frame detected by the load detector. The circuitry is configured not to output the output signal or to output the output signal that sets the magnitude of the operation to zero, when the load detection value detected by the load detector is less than a predetermined threshold.

3 Claims, 10 Drawing Sheets

(51) Int. Cl.
*G05G 5/00* (2006.01)
*G05G 5/05* (2006.01)

(58) Field of Classification Search
CPC ..... H01H 25/04; H01H 3/02; H01H 3/04; H01H 3/12; H01H 3/122; H01H 3/46; H01H 2003/127; H01H 13/14; A63F 13/245; A63F 13/24; A63F 13/20; A63F 2300/10; A63F 2300/1043
See application file for complete search history.

(56) References Cited

U.S. PATENT DOCUMENTS

| | | | | |
|---|---|---|---|---|
| 11,042,179 | B1 * | 6/2021 | Muranaka ..... | G05G 1/04 |
| 2015/0198964 | A1 | 7/2015 | Asano | |
| 2016/0313759 | A1 | 10/2016 | Okamura et al. | |
| 2018/0299967 | A1 | 10/2018 | Hirose et al. | |
| 2020/0097037 | A1 | 3/2020 | Asano | |
| 2020/0209908 | A1 | 7/2020 | Arita et al. | |
| 2020/0326746 | A1 | 10/2020 | Koike et al. | |
| 2020/0360802 | A1 | 11/2020 | Sakamoto et al. | |

* cited by examiner

MULTIDIRECTIONAL INPUT DEVICE

CROSS-REFERENCE TO RELATED APPLICATIONS

This application is a continuation of U.S. patent application Ser. No. 17/102,626, filed on Nov. 24, 2020, which is based upon and claims priority to Japanese patent application No. 2019-227697, filed on Dec. 17, 2019. The entire contents of the foregoing applications are hereby incorporated herein by reference.

BACKGROUND OF THE INVENTION

1. Field of the Invention

The present invention relates to multidirectional input devices.

2. Description of the Related Art

Multidirectional input devices tiltable with an operating member have been known as, for example, multidirectional input devices used for game machines and the like. For example, Japanese Laid-open patent application No. 2000-250649 illustrates, with respect to a movable body controller that can control a movable body such as a vehicle, a technique to control a movable body according to an angle of operation detected with a rotation detecting sensor in a tilt area within a predetermined angle from the neutral position of an operating member and control the movable body by detecting the operating force of the operating member with a pressure sensor when the operating member is further operated.

SUMMARY OF THE INVENTION

According to an aspect of the present invention, a multidirectional input device includes an operation input part, a base, a load detector, and circuitry. The operation input part includes an operation stick configured to be tilted in a horizontal direction by an operation on the operation stick, a tilt detector configured to detect an angle detection value representing the tilt direction and the tilt angle of the operation stick, a returning part configured to return the operation stick to neutral state, and a frame storing the tilt detector, the returning part, and part of the operation stick. The base has a plate shape and is provided below the frame. The load detector is provided on the frame or the base and configured to detect a load detection value representing the direction and the magnitude of a load applied to the frame. The circuitry is configured to output an output signal representing the direction and the magnitude of the operation on the operation stick, based on the angle detection value detected by the tilt detector and the load detection value detected by the load detector. The circuitry is configured not to output the output signal or to output the output signal that sets the magnitude of the operation to zero, when the load detection value detected by the load detector is less than a predetermined threshold.

DETAILED DESCRIPTION OF THE EMBODIMENTS

Figure 1:
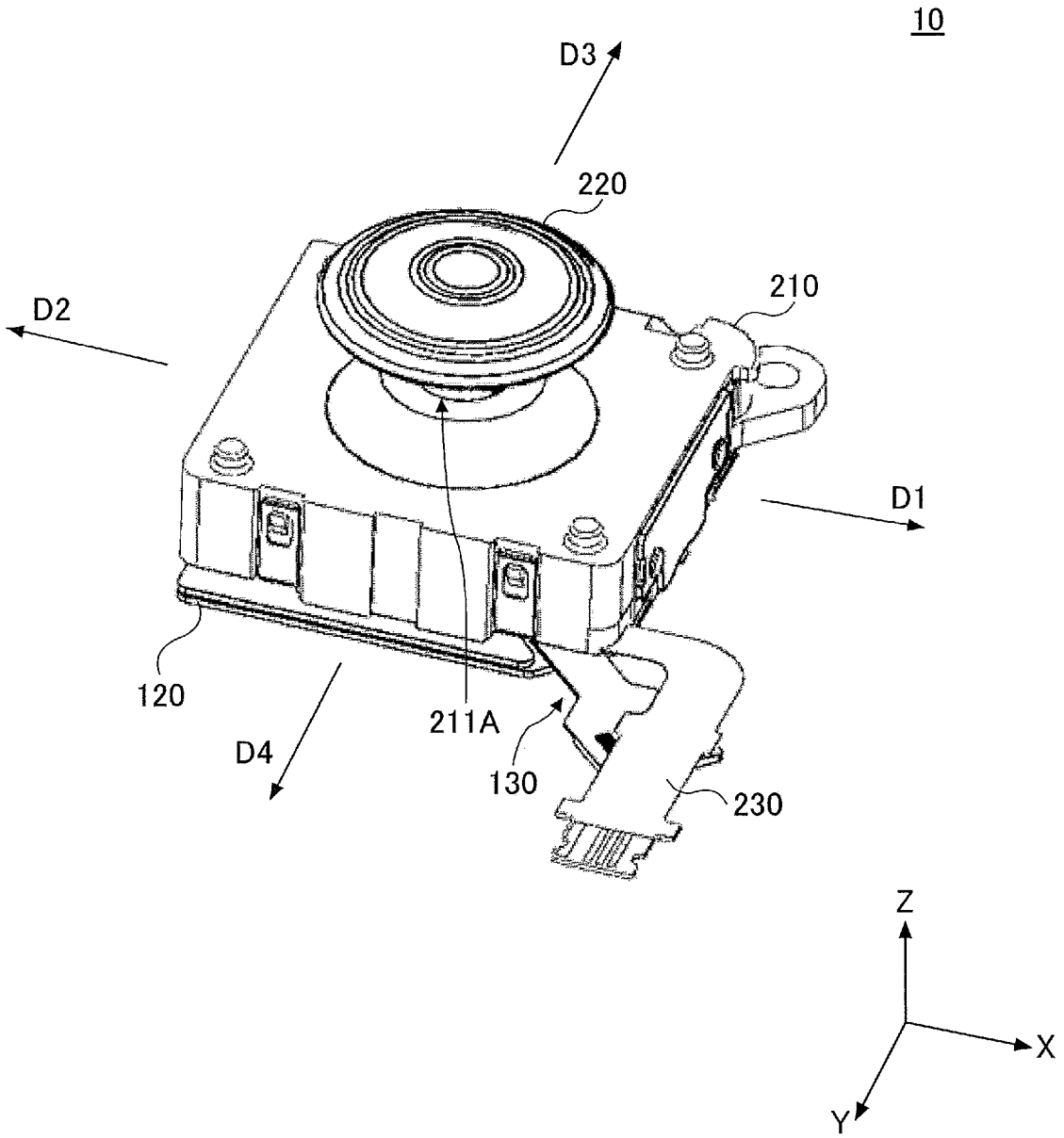
FIG. 1 is a top-side perspective view of a multidirectional input device according to an embodiment.

According to the above-described related-art technique, even when the operating member is not operated by a user, the presence of the user's operation on the operating member is erroneously detected when the operating member is slightly tilted because of the tilt of the multidirectional input device, or the like.

According to an embodiment, it is possible to prevent erroneous detection of a user's operation on an operating member.

An embodiment is described below. In the following description, for convenience, the Z axis direction (representing a direction along the Z axis), the X axis direction (representing a direction along the X axis), and the Y axis direction (representing a direction along the Y axis) in the drawings are a top-to-bottom direction, a front-to-rear direction, and a left-to-right direction, respectively. Furthermore, the X axis direction and the Y axis direction in the drawings are horizontal directions.

Figure 2:
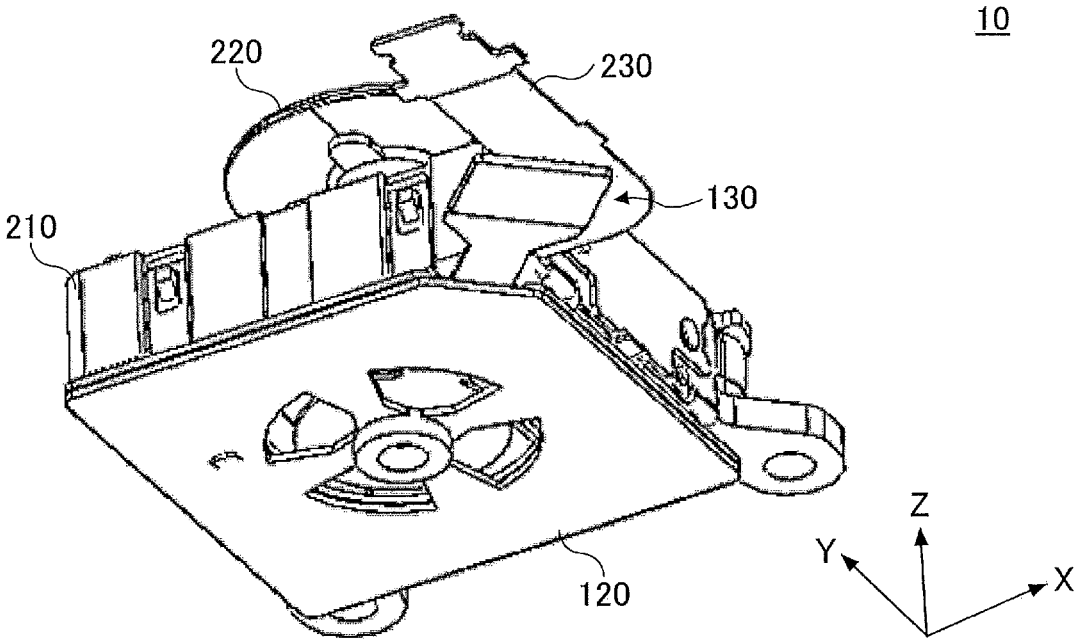
FIG. 2 is a bottom-side perspective view of the multidirectional input device according to the embodiment.

An overview of a multidirectional input device 10 according to an embodiment is given. FIG. 1 is a top-side perspective view of the multidirectional input device 10. FIG. 2 is a bottom-side perspective view of the multidirectional input device 10.

The multidirectional input device 10 is an input device used for the controller or the like of a game machine or the like. Referring to FIGS. 1 and 2, the multidirectional input device 10 includes a case 210, an operating member 220 (for example, a control stick), and a flexible printed circuit (FPC) 230.

The case 210 is an example of a "frame." The case 210 is a box-shaped member that supports the operating member 220 in a tiltable manner. The operating member 220 is an example of an "operation stick." The operating member 220 protrudes upward through an opening 211A formed in the center of the top of the case 210 to be tilted by a user. The operating member 220 is tiltable in any horizontal direction. The FPC 230 is a flexible interconnect member in film form extended from the inside to the outside of the case 210.

The multidirectional input device 10 allows the operating member 220 to tilt in the front-to-rear direction (directions of arrows D1 and D2 in the drawings) and in the left-to-right direction (directions of arrows D3 and D4 in the drawings). Furthermore, the multidirectional input device 10 allows the operating member 220 to also perform tilting that is a combination of tilting in the front-to-rear direction and tilting in the left-to-right direction.

Furthermore, the multidirectional input device 10 can output an angle detection value in the X axis direction (the front-to-rear direction) and an angle detection value in the Y axis direction (the left-to-right direction) to the outside through the FPC 230 as an operation signal corresponding to the tilting (tilt direction and tilt angle) of the operating member 220.

Furthermore, referring to FIGS. 1 and 2, the multidirectional input device 10 includes a plate-shaped base 120 provided below the case 210 and a load detector 130 provided between the case 210 and the base 120. The multidirectional input device 10 can detect distortion caused in the base 120 by a load applied to the case 210, using the load detector 130, and output a distortion detection value representing the detected distortion to the outside.

Figure 3:
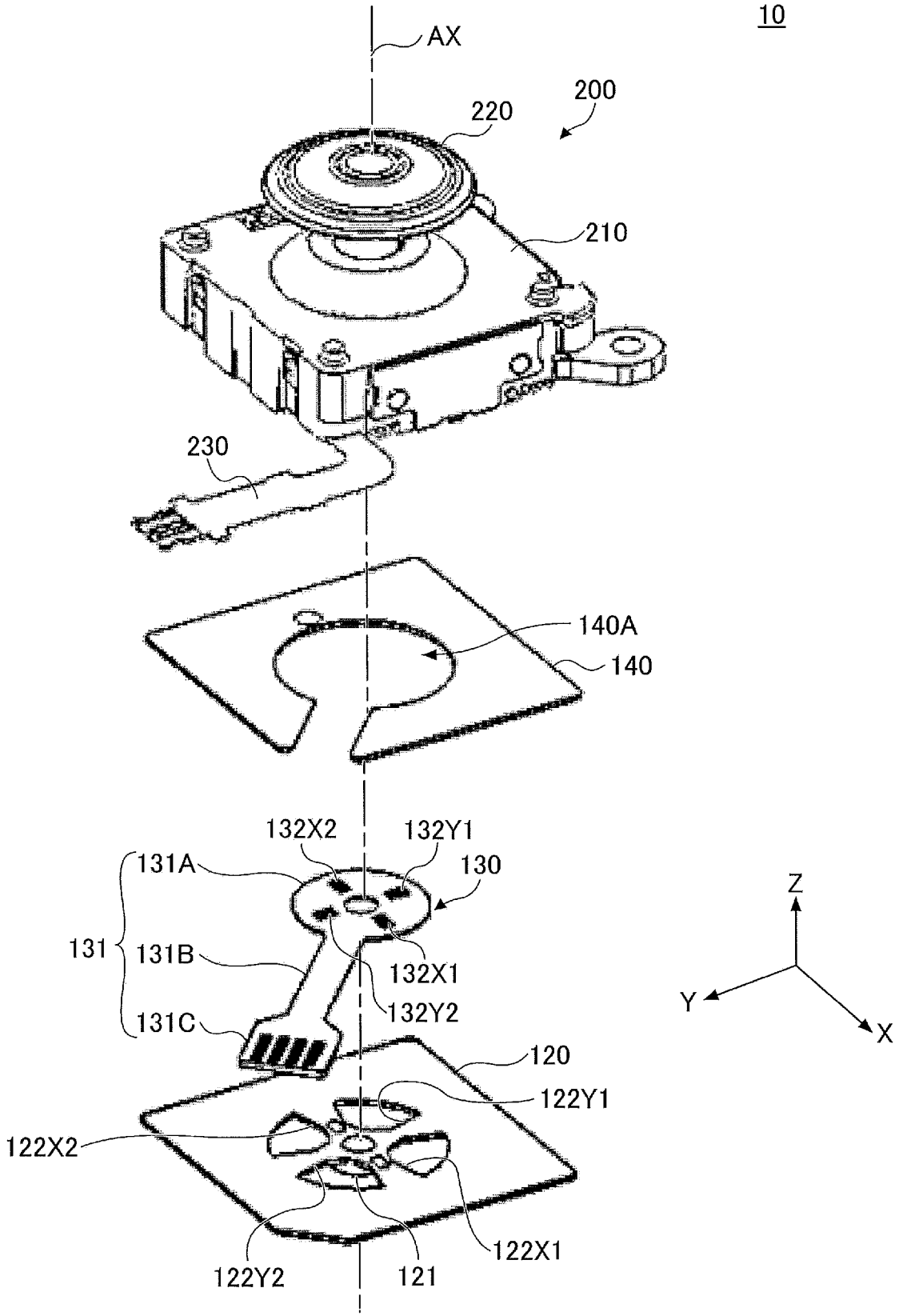
FIG. 3 is an exploded perspective view of the multidirectional input device according to the embodiment.
Figure 4:
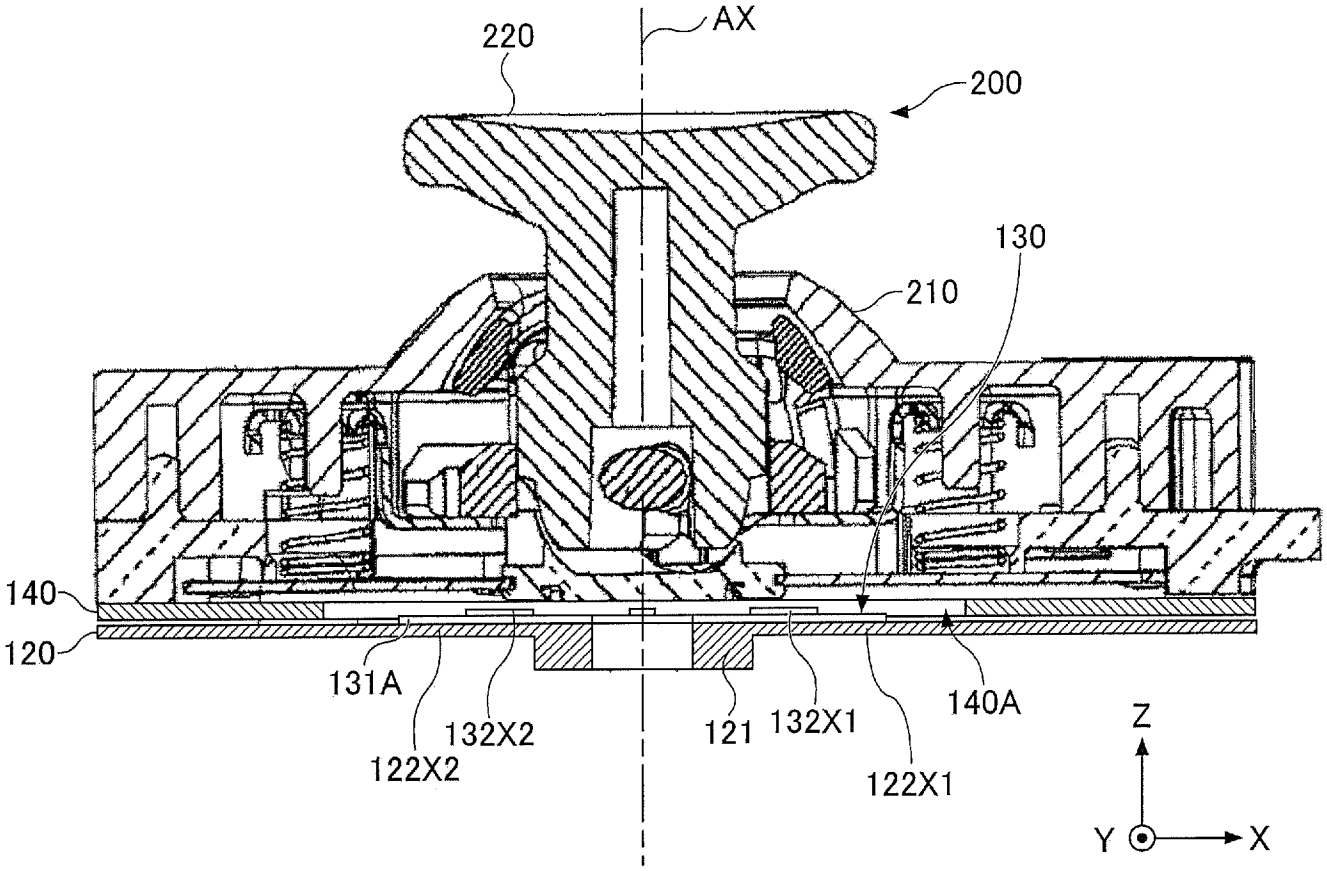
FIG. 4 is a sectional view of the multidirectional input device according to the embodiment.

Next, a configuration of the multidirectional input device 10 is described. FIG. 3 is an exploded perspective view of the multidirectional input device 10 according to the embodiment. FIG. 4 is a sectional view of the multidirectional input device 10 according to the embodiment. Referring to FIGS. 3 and 4, the multidirectional input device 10 includes, in order from top to bottom, an operation input part 200, a spacer 140, the load detector 130, and the base 120.

As described with reference to FIGS. 1 and 2, the operation input part 200 includes the case 210, the operating member 220, and the FPC 230, and is where tilting is performed with the operating member 220. The operation input part 200 is a so-called analog controller that can output an operation signal commensurate with the direction of operation and the amount of operation of the operating member 220. An example of a detailed configuration of the operation input part 200 is described below with reference to FIG. 5.

The base 120 is a flat plate-shaped member attached to the bottom of the case 210 of the operation input part 200 through the spacer 140. The base 120 is fixed to the bottom of the case 210 using a desired fixing method. The base 120 includes a columnar part 121 and four beam parts 122X1, 122X2, 122Y1, and 122Y2.

The columnar part 121 has a cylindrical shape and is provided in the center of the bottom surface of the base 120 (coaxially with a central axis AX of the operating member 220) to protrude downward. When the multidirectional input device 10 is mounted on an external mounting surface, the bottom surface of the columnar part 121 is fixed to the mounting surface.

The four beam parts 122X1, 122X2, 122Y1, and 122Y2 support the upper end of the columnar part 121 from four directions. Specifically, the beam part 122X1 supports the upper end of the columnar part 121 from the front side (the positive side of the X axis) of the columnar part 121. The beam part 122X2 supports the upper end of the columnar part 121 from the rear side (the negative side of the X axis) of the columnar part 121. The beam part 122Y1 supports the upper end of the columnar part 121 from the left side (the negative side of the Y axis) of the columnar part 121. The beam part 122Y2 supports the upper end of the columnar part 121 from the right side (the positive side of the Y axis) of the columnar part 121.

The load detector 130 is provided within an opening 140A of the spacer 140 between the operation input part 200 and the base 120. The load detector 130 detects distortion caused in the base 120 by a load applied to the case 210 and outputs a distortion detection value representing the detected distortion to the outside. The load detector 130 includes an FPC 131 and four distortion sensors 132X1, 132X2, 132Y1, and 132Y2.

The FPC 131 is a flexible interconnect member in film form. The FPC 131 includes a base 131A, a lead part 131B, and a connection part 131C. The base 131A has a circular shape and is placed below the center of the bottom of the case 210 (coaxially with the central axis AX of the operating member 220). The four distortion sensors 132X1, 132X2, 132Y1, and 132Y2 are placed on the base 131A. The lead part 131B extends horizontally and rectilinearly from the base 131A to the outside of the case 210. The connection part 131C is provided at the distal end of the lead part 131B for external connection (to a connector or the like). The FPC 131 outputs distortion detection values output from the four distortion sensors 132X1, 132X2, 132Y1, and 132Y2 to the outside from the connection part 131C.

The four distortion sensors 132X1, 132X2, 132Y1, and 132Y2 are placed in four directions with respect to the central axis AX on the base 131A of the FPC 131, and detect distortion caused in the base 120 by the transmission of a load applied to the case 210 to the base 120.

Specifically, the distortion sensor 132X1 is placed over the beam part 122X1 on the front side (the positive side of the X axis) of the central axis AX on the base 131A. The distortion sensor 132X1 detects distortion caused in the beam part 122X1 and outputs a distortion detection value representing the distortion.

The distortion sensor 132X2 is placed over the beam part 122X2 on the rear side (the negative side of the X axis) of the central axis AX on the base 131A. The distortion sensor 132X2 detects distortion caused in the beam part 122X2 and outputs a distortion detection value representing the distortion.

The distortion sensor 132Y1 is placed over the beam part 122Y1 on the left side (the negative side of the Y axis) of the central axis AX on the base 131A. The distortion sensor 132Y1 detects distortion caused in the beam part 122Y1 and outputs a distortion detection value representing the distortion.

The distortion sensor 132Y2 is placed over the beam part 122Y2 on the right side (the positive side of the Y axis) of the central axis AX on the base 131A. The distortion sensor 132Y2 detects distortion caused in the beam part 122Y2 and outputs a distortion detection value representing the distortion.

The spacer 140 is a flat plate-shaped member provided between the operation input part 200 and the base 120. The spacer 140 forms a space for installing the load detector 130 between the operation input part 200 and the base 120. Specifically, the spacer 140 has a thickness slightly larger than the maximum thickness of the load detector 130. Furthermore, the opening 140A having a shape along the circumferential shape of the load detector 130 (the base 131A and the lead part 131B) is formed in the spacer 140, so that the spacer 140 allows the load detector 130 (the base 131A and the lead part 131B) to be installed within the opening 140A between the operation input part 200 and the base 120.

Figure 5:
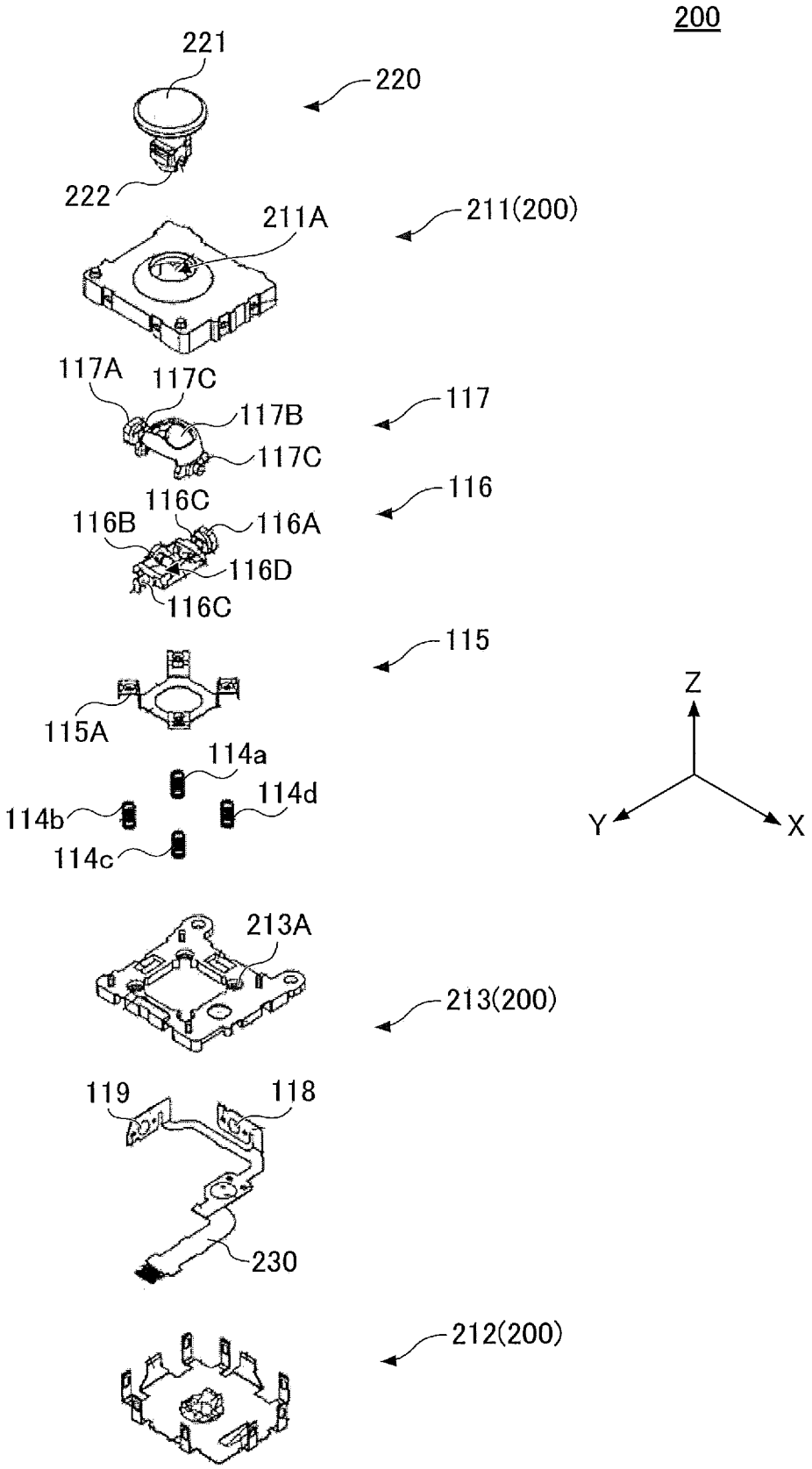
FIG. 5 is an exploded perspective view of an example configuration of an operation input part of the multidirectional input device according to the embodiment.

Next, a configuration of the operation input part 200 is described. FIG. 5 is an exploded perspective view of an example configuration of the operation input part 200 of the multidirectional input device 10 according to the embodiment.

Referring to FIG. 5, the multidirectional input device 10 includes the case 210. The case 210 includes an upper case 211, a lower case 212, and a middle case 213. The upper case 211 includes the opening 211A, through which the operating member 220 vertically passes. The upper case 211, the lower case 212, and the middle case 213 are assembled into the case 210 such that the case 210 has a box shape with an internal storage (accommodation) space.

Referring to FIG. 5, the operating member 220 includes an operating part 221 and a stem 222. The operating part 221 protrudes upward from the opening 211A of the upper case 211 to be positioned over the case 210. The operating part 221 is tilted by an operator. The stem 222 extends downward from the operating part 221 to pass through the opening 211A. The lower end of the stem 222 engages with a shaft 116B of a first linked member 116 described below.

Four coil springs 114*a*, 114*b*, 114*c*, and 114*d*, a spring holder 115, the first linked member 116, and a second linked member 117 are stored in the case 210 (between the upper case 211 and the middle case 213).

The four coil springs 114*a*, 114*b*, 114*c*, and 114*d* are examples of "return springs." The four coil springs 114*a*, 114*b*, 114*c*, and 114*d* are placed in through holes 213A of the middle case 213 in four directions with respect to the central axis AX in such a manner as to be vertically elastically deformable. The four coil springs 114*a*, 114*b*, 114*c*, and 114*d* urge the spring holder 115 upward with their own elastic recovery forces at their respective positions in the four directions with respect to the central axis AX.

The spring holder 115 is formed by processing a metal plate. The spring holder 115 includes four receivers 115A provided in four directions with respect to the central axis AX. The four receivers 115A receive the respective upper ends of the four coil springs 114*a*, 114*b*, 114*c*, and 114*d*. The spring holder 115 elastically contacts the lower surfaces of the first linked member 116 and the second linked member 117 to cause urging forces from the four coil springs 114*a*, 114*b*, 114*c*, and 114*d* to act on the first linked member 116 and the second linked member 117.

The first linked member 116 is an example of a "coupled part." The first linked member 116 pivots in the X axis direction as the operating member 220 is tilted in the X axis direction. The first linked member 116 has an opening 116D that is rectangular in a top plan view. The columnar shaft 116B extending in the X axis direction is provided within the opening 116D. The shaft 116B engages with the lower end of the stem 222 of the operating member 220 to restrict the vertical movement of the operating member 220. The first linked member 116 includes a pair of columnar shafts 116C protruding in the Y axis direction, provided one at each Y axial end of the first linked member 116. The first linked member 116 is pivotably supported in the X axis direction by the upper case 211 with the shafts 116C pivotably supported by bearing parts (not depicted) provided in the upper case 211. A magnet 116A for detecting the pivoting of the first linked member 116 is provided at the end of one of the shafts 116C. The lower surface of the first linked member 116 that contacts the spring holder 115 is a flat surface. When the operating member 220 is not operated, the lower surface of the first linked member 116 is in surface contact with the spring holder 115 because of the respective urging forces of the four coil springs 114*a*, 114*b*, 114*c*, and 114*d*. As a result, the first linked member 116 is not pivoted in the X axis direction (that is, causes the operating member 220 to be in neutral).

The second linked member 117 is another example of the "coupled part." The second linked member 117 pivots in the Y axis direction as the operating member 220 is tilted in the Y axis direction. The second linked member 117 is placed over and orthogonal to the first linked member 116. The second linked member 117 has an upward curving arch shape, and an opening 117B is formed along the length of its arch-shaped portion. The stem 222 of the operating member 220 passes through the opening 117B. The second linked member 117 includes a pair of columnar shafts 117C protruding in the X axis direction, provided one at each X axial end of the second linked member 117. The second linked member 117 is pivotably supported in the Y axis direction by the upper case 211 with the shafts 117C pivotably supported by bearing parts (not depicted) provided in the upper case 211. A magnet 117A for detecting the pivot angle of the second linked member 117 is provided at the end of one of the shafts 117C. The lower surface of the second linked member 117 that contacts the spring holder 115 is a flat surface. When the operating member 220 is not operated, the lower surface of the second linked member 117 is in surface contact with the spring holder 115 because of the respective urging forces of the four coil springs 114*a*, 114*b*, 114*c*, and 114*d*. As a result, the second linked member 117 is not pivoted in the Y axis direction (that is, causes the operating member 220 to be in neutral).

Furthermore, referring to FIG. 5, a rotation sensor 118 and a rotation sensor 119 are provided in the case 210 (between the middle case 213 and the lower case 212) of the multidirectional input device 10 as examples of "tilt detectors." According to this embodiment, giant magnetoresistance (GMR) elements are used as the rotation sensors 118 and 119.

The rotation sensor 118 is positioned opposite the magnet 116A provided on the first linked member 116 on the FPC 230 and detects the pivot angle of the first linked member 116 in the X axis direction (that is, the tilt angle of the operating member 220 in the X axis direction). The rotation sensor 118 outputs an angle detection value that represents the pivot angle of the first linked member 116 in the X axis direction via the FPC 230.

The rotation sensor 119 is positioned opposite the magnet 117A provided on the second linked member 117 on the FPC 230 and detects the pivot angle of the second linked member 117 in the Y axis direction (that is, the tilt angle of the operating member 220 in the Y axis direction). The rotation sensor 119 outputs an angle detection value that represents the pivot angle of the second linked member 117 in the Y axis direction via the FPC 230.

According to the multidirectional input device 10 configured as described above, when the operating member 220 is tilted, one or both of the first linked member 116 and the second linked member 117 pivot. As a result, an angle detection value commensurate with the tilt direction and the tilt angle of the operating member 220 is output from one or both of the rotation sensors 118 and 119 to the outside (for example, a controller 150 described below) via the FPC 230.

When the tilting of the operating member 220 is canceled, the operating member 220 returns to neutral because of urging forces from the four coil springs 114*a*, 114*b*, 114*c*, and 114*d* via the spring holder 115, the first linked member 116, and the second linked member 117.

Furthermore, according to the multidirectional input device 10, not only when the operating member 220 is tilted, but also when a load is applied to the case 210, a distortion commensurate with the direction and magnitude of the applied load is caused in the four beam parts 122X1, 122X2, 122Y1, and 122Y2 of the base 120 with the columnar part 121 being fixed. In this case, the four distortion sensors 132X1, 132X2, 132Y1, and 132Y2 detect distortions in the four beam parts 122X1, 122X2, 122Y1, and 122Y2, respectively. A distortion detection value is output from each of the four distortion sensors 132X1, 132X2, 132Y1, and 132Y2 to the outside (for example, the controller 150 described below) via the FPC 131.

Figure 6:
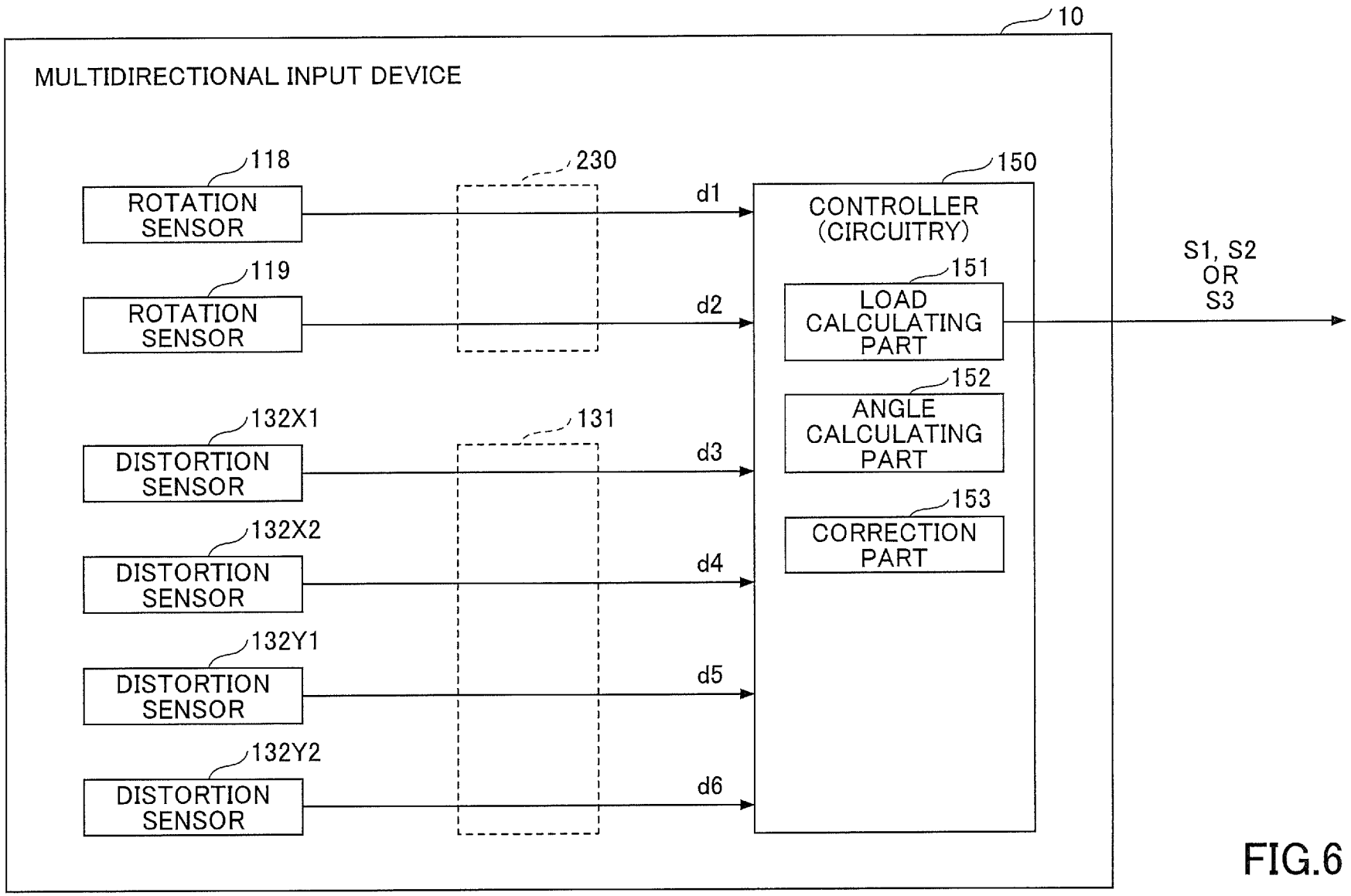
FIG. 6 is a block diagram illustrating an electrical connection configuration of the multidirectional input device according to the embodiment.

Next, an electrical connection configuration of the multidirectional input device 10 is described. FIG. 6 is a block diagram illustrating an electrical connection configuration of the multidirectional input device 10 according to the embodiment. Referring to FIG. 6, the multidirectional input device 10 further includes the controller 150 in addition to the rotation sensors 118 and 119 and the distortion sensors 132X1, 132X2, 132Y1, and 132Y2.

The controller 150 is an example of "circuitry." The controller 150 performs various kinds of control on the multidirectional input device 10. Examples of the controller 150 include integrated circuits (ICs), which include, for example, a microcontroller.

The controller 150 is connected to the rotation sensors 118 and 119 via the FPC 230. The controller 150 receives angle detection values d1 and d2 output by the rotation sensors 118 and 119 via the FPC 230.

Furthermore, the controller 150 is connected to the distortion sensors 132X1, 132X2, 132Y1, and 132Y2 via the FPC 131. The controller 150 receives distortion detection values d3, d4, d5, and d6 output by the distortion sensors 132X1, 132X2, 132Y1, and 132Y2 via the FPC 131.

The controller 150 include a load calculating part 151, an angle calculating part 152, and a correction part 153 as functional elements. The load calculating part 151 can calculate load calculation values representing loads in the X axis direction, the Y axis direction, and the Z axis direction applied to the multidirectional input device 10, according to predetermined calculation formulae based on the distortion detections values d3, d4, d5, and d6 (analog signals).

The angle calculating part 152 can calculate angle calculation values representing the tilt angles of the operating member 220 in the X axis direction and the Y axis direction, according to predetermined calculation formulae based on the load calculation values in the X axis direction, the Y axis direction, and the Z axis direction calculated by the load calculating part 151.

The controller 150 can output one or more signals (output signals) representing the direction and magnitude of a user's operation performed on the operating member 220 to an output target device (such as a game machine), based on the angle detection values d1 and d2 (or the angle calculation values calculated by the angle calculating part 152) and the load calculation values calculated by the load calculating part 151.

As a first example, the controller 150 can output an angle output signal S1 (a digital signal) representing the angle detection values d1 and d2 to the output target device. In addition, the controller 150 can output a load output signal S2 (a digital signal) representing the load calculation values in the X axis direction, the Y axis direction, and the Z axis direction calculated by the load calculating part 151 to the output target device.

As a second example, the controller 150 can output an output signal S3 (a digital signal) instead of the angle output signal S1 and the load output signal S2. The output signal S3 includes angle output values representing the tilt angles of the operating member 220 in the X axis direction and the Y axis direction and a load output value representing a downward load calculation value calculated by the load calculating part 151.

When the tilted operating member 220 is at a position other than a movement limit position, the controller 150 employs the angle detection values d1 and d2 as the angle output values. When the tilted operating member 220 is at the movement limit position, the controller 150 employs the angle calculation values calculated by the angle calculating part 152 as the angle output values.

The correction part 153, when the operating member 220 is not operated by a user for a certain period of time (specifically, when there is no change in the load calculation value in each of the X axis direction, the Y axis direction, and the Z axis direction for a certain period of time), can correct the origin of the load detector 130 using the output values of the load detector 130 (the distortion detection values d3, d4, d5, and d6) at the time.

Figure 7:
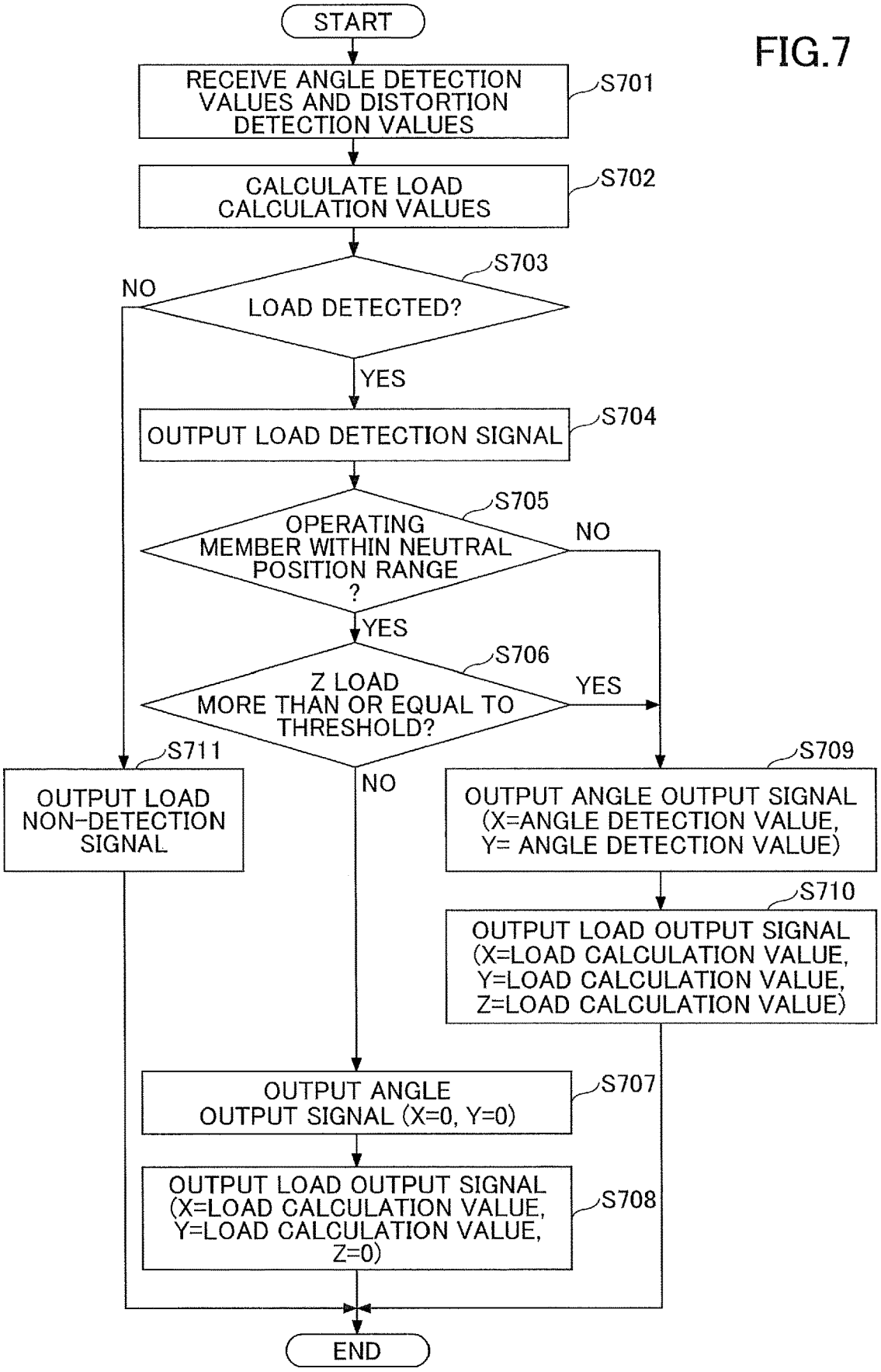
FIG. 7 is a flowchart illustrating an example (first example) of a process executed by a controller according to the embodiment.

Next, an example (first example) of a process executed by the controller 150 is described. FIG. 7 is a flowchart illustrating an example (first example) of a process executed by the controller 150 according to the embodiment. Here, an example where the controller 150 outputs the angle output signal S1 and the load output signal S2 to the output target device is described.

First, at step S701, the controller 150 receives the angle detection values d1 and d2 and the distortion detection values d3, d4, d5, and d6. Next, at step S702, the controller 150 calculates load calculation values in the X axis direction, the Y axis direction, and the Z axis direction based on the distortion detection values d3, d4, d5, and d6 received at step S701.

Next, at step S703, the controller 150 determines whether a load is applied to the multidirectional input device 10 based on the load calculation values calculated at step S702. For example, the controller 150 determines that "a load is applied to the multidirectional input device 10" if at least one of the load calculation values in the X axis direction, the Y axis direction, and the Z axis direction calculated at step S702 is other than "0."

In response to determining at step S703 that no load is applied (NO at step S703), at step S711, the controller 150 outputs a load non-detection signal to the output target device. The load non-detection signal is a Boolean signal indicating the presence or absence of load detection. Then, the controller 150 ends the series of processes illustrated in FIG. 7.

In response to determining at step S703 that a load is applied (YES at step S703), at step S704, the controller 150 outputs a load detection signal to the output target device. The load detection signal is a Boolean signal indicating the presence or absence of load detection. While the multidirectional input device 10 is in operation, only one of the load non-detection signal and the load detection signal is output. Then, at step S705, the controller 150 determines whether the tilt angle of the operating member 220 is within a predetermined neutral position range based on the angle detection values d1 and d2 received at step S701. For example, the controller 150 determines that "the operating member 220 is in neutral" if each of the angle calculation values in the X axis direction and the Y axis direction calculated at step S702 is "0."

In response to determining at step S705 that the tilt angle of the operating member 220 is not within a predetermined neutral position range (NO at step S705), at step S709, the controller 150 outputs the angle output signal S1 representing the angle detection values d1 and d2 received at step S701 to the output target device. Furthermore, at step S710, the controller 150 outputs the load output signal S2 representing the load calculation values in the X axis direction, the Y axis direction, and the Z axis direction calculated at step S702 to the output target device. Then, the controller 150 ends the series of processes illustrated in FIG. 7.

In response to determining at step S705 that the tilt angle of the operating member 220 is within a predetermined neutral position range (YES at step S705), at step S706, the controller 150 determines whether the load calculation value in the Z axis direction calculated at step S702 is more than or equal to a predetermined threshold.

In response to determining at step S706 that the load calculation value in the Z axis direction is more than or equal to a predetermined threshold (YES at step S706), at step S709, the controller 150 outputs the angle output signal S1 representing the angle detection values d1 and d2 received at step S701 to the output target device. Furthermore, at step S710, the controller 150 outputs the load output signal S2 representing the load calculation values in the X axis direction, the Y axis direction, and the Z axis direction calculated at step S702 to the output target device. Then, the controller 150 ends the series of processes illustrated in FIG. 7.

In response to determining at step S706 that the load calculation value in the Z axis direction is not more than or equal to a predetermined threshold (NO at step S706), at step S707, the controller 150 outputs the angle output signal S1 that sets the angle output value in the X axis direction to "0" and sets the angle output value in the Y axis direction to "0." Furthermore, at step S708, the controller 150 outputs, to the output target device, the load output signal S2 that sets the load output value in the X axis direction to the load calculation value in the X axis direction calculated at step S702, sets the load output value in the Y axis direction to the load calculation value in the Y axis direction calculated at step S702, and sets the load output value in the Z axis direction to "0." Then, the controller 150 ends the series of processes illustrated in FIG. 7.

According to the series of processes illustrated in FIG. 7, the controller 150 outputs neither the angle output signal S1 nor the load output signal S2 if the load detection values detected by the load detector 130 (namely, the load calculation values based on the distortion detection values d3, d4, d5, and d6) are less than predetermined thresholds. This enables the controller 150 to prevent erroneous detection of a user's operation on the operating member 220 when the operating member 220 is slightly tilted because of the tilt of the multidirectional input device 10 or the like, although the operating member 220 is not operated by the user.

Instead of outputting neither the angle output signal S1 nor the load output signal S2, the controller 150 may output the angle output signal S1 that sets each angle output value to "0" and the load output signal S2 that sets each load output value to "0."

Furthermore, the controller 150 may output the load output signal S2 that sets the load output value in the Z axis direction to the load calculation value in the Z axis direction to the output target device if the tilt of the operating member 220 is within a predetermined neutral position range and the load calculation value in the Z axis direction is more than or equal to a predetermined threshold. Accordingly, when the operating member 220 is pushed in the Z axis direction, the controller 150 enables the output target device to detect the pushing.

Furthermore, the controller 150 can output the load output signal S2 that sets the load output value in the Z axis direction to "0" to the output target device if the tilt of the operating member 220 is within a predetermined neutral position range and the load calculation value in the Z axis direction is less than a predetermined threshold. This enables the controller 150 to prevent erroneous detection of a load in the Z axis direction caused by error due to the self-weight of the operating member 220, error due to noise, or the like while the operating member 220 is not operated.

Figure 8:
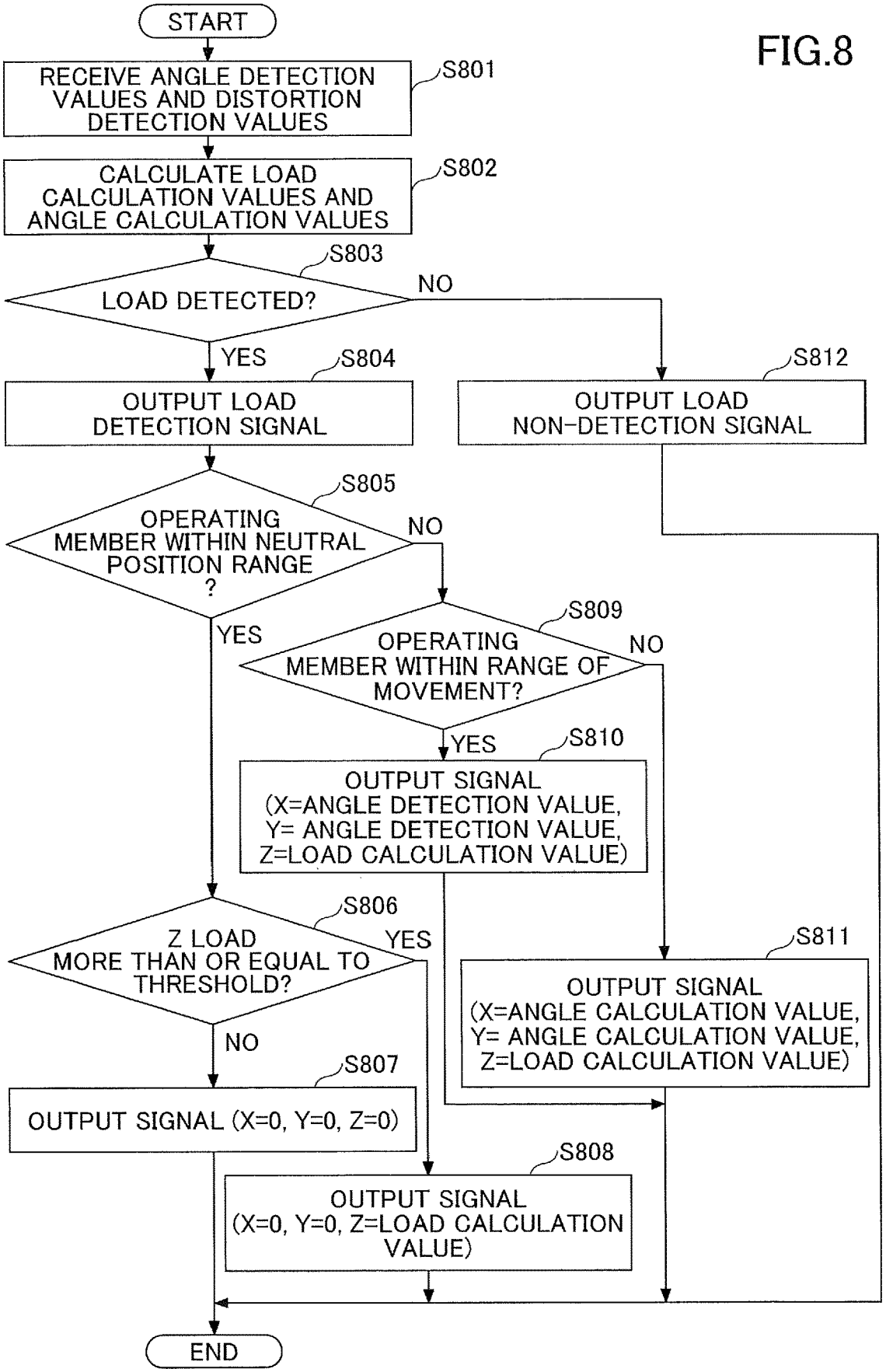
FIG. 8 is a flowchart illustrating an example (second example) of a process executed by the controller according to the embodiment.

Next, a second example of a process executed by the controller 150 is described. FIG. 8 is a flowchart illustrating an example (second example) of a process executed by the controller 150 according to the embodiment. Here, an example where the controller 150 outputs the output signal S3 to the output target device is described.

First, at step S801, the controller 150 receives the angle detection values d1 and d2 and the distortion detection values d3, d4, d5, and d6.

Next, at step S802, the controller 150 calculates load calculation values in the X axis direction, the Y axis direction, and the Z axis direction based on the distortion detection values d3, d4, d5, and d6 received at step S801 and calculates angle calculation values in the X axis direction and the Y axis direction based on the load calculation values.

Next, at step S803, the controller 150 determines whether a load is applied to the multidirectional input device 10 based on the load calculation values calculated at step S802. For example, the controller 150 determines that "a load is applied to the multidirectional input device 10" if at least one of the load calculation values in the X axis direction, the Y axis direction, and the Z axis direction calculated at step S802 is other than "0."

In response to determining at step S803 that no load is applied (NO at step S803), at step S812, the controller 150 outputs a load non-detection signal to the output target device. The load non-detection signal is a Boolean signal indicating the presence or absence of load detection. The controller 150 may output "0" as the load non-detection signal using an interconnect shared with a load detection signal described below. Then, the controller 150 ends the series of processes illustrated in FIG. 8.

In response to determining at step S803 that a load is applied (YES at step S803), at step S804, the controller 150 outputs a load detection signal to the output target device. The load detection signal is a Boolean signal indicating the presence or absence of load detection. The controller 150 may output "1" as the load detection signal using the above-described interconnect shared with the load non-detection signal. Then, at step S805, the controller 150 determines, based on the angle detection values d1 and d2 received at step S801, whether the tilt angle of the operating member 220 is within a predetermined neutral position range (see FIG. 10). For example, the controller 150 determines that "the tilt angle of the operating member 220 is within a predetermined neutral position range" if each of the values of the angle detection values d1 and d2 is "0."

In response to determining that the tilt angle of the operating member 220 is not within a predetermined neutral position range (NO at step S805), at step S809, the controller 150 determines whether the tilt angle of the operating member 220 is within a predetermined range of movement (that is, less than a movement limit angle).

In response to determining at step S809 that the tilt angle of the operating member 220 is within a predetermined range of movement (YES at step S809), at step S810, the controller 150 outputs, to the output target device, the output signal S3 that sets the angle detection values d1 and d2 received at step S801 as the angle output values and sets the load calculation value in the Z axis direction calculated at step S802 as the load output value. Then, the controller 150 ends the series of processes illustrated in FIG. 8.

In response to determining at step S809 that the tilt angle of the operating member 220 is not within a predetermined range of movement (NO at step S809), at step S811, the controller 150 outputs, to the output target device, the output signal S3 that sets the angle calculation values in the X axis direction and the Y axis direction calculated at step S802 as the angle output values and sets the load calculation value in the Z axis direction calculated at step S802 as the load output value. Then, the controller 150 ends the series of processes illustrated in FIG. 8. The angle calculation values are values based on the load detection values. Therefore, the controller 150 can output a tilt angle that exceeds the physical tilt angle of the operating member 220.

In response to determining at step S805 that the tilt angle of the operating member 220 is within a predetermined neutral position range (YES at step S805), at step S806, the controller 150 determines whether the load calculation value in the Z axis direction calculated at step S802 is more than or equal to a predetermined threshold.

In response to determining at step S806 that the load calculation value in the Z axis direction is more than or equal to a predetermined threshold (YES at step S806), at step S808, the controller 150 outputs, to the output target device, the output signal S3 that sets the angle output value in the X axis direction to "0," sets the angle output value in the Y axis direction to "0," and sets the load output value in the Z axis direction to the load calculation value in the Z axis direction calculated at step S802. Then, the controller 150 ends the series of processes illustrated in FIG. 8.

In response to determining at step S806 that the load calculation value in the Z axis direction is not more than or equal to a predetermined threshold (NO at step S806), at step S807, the controller 150 outputs, to the output target device, the output signal S3 that sets the angle output value in the X axis direction to "0," sets the angle output value in the Y axis direction to "0," and sets the load output value in the Z axis direction to "0." Then, the controller 150 ends the series of processes illustrated in FIG. 8.

According to the series of processes illustrated in FIG. 8, when the tilt angle of the operating member 220 is a movement limit angle, the controller 150 can output the angle calculation values calculated based on the distortion detection values d3, d4, d5, and d6 as the angle output values representing the tilt angles of the operating member 220 in the X axis direction and the Y axis direction. Accordingly, when the operating member 220 is further pushed with the tilt angle of the operating member 220 being a movement limit angle, the controller 150 can output angle output values that represent the virtual tilt angles (tilt angles exceeding physical tilt angles) of the operating member 220 according to a load applied to the multidirectional input device 10 by this further pushing.

Figure 9:
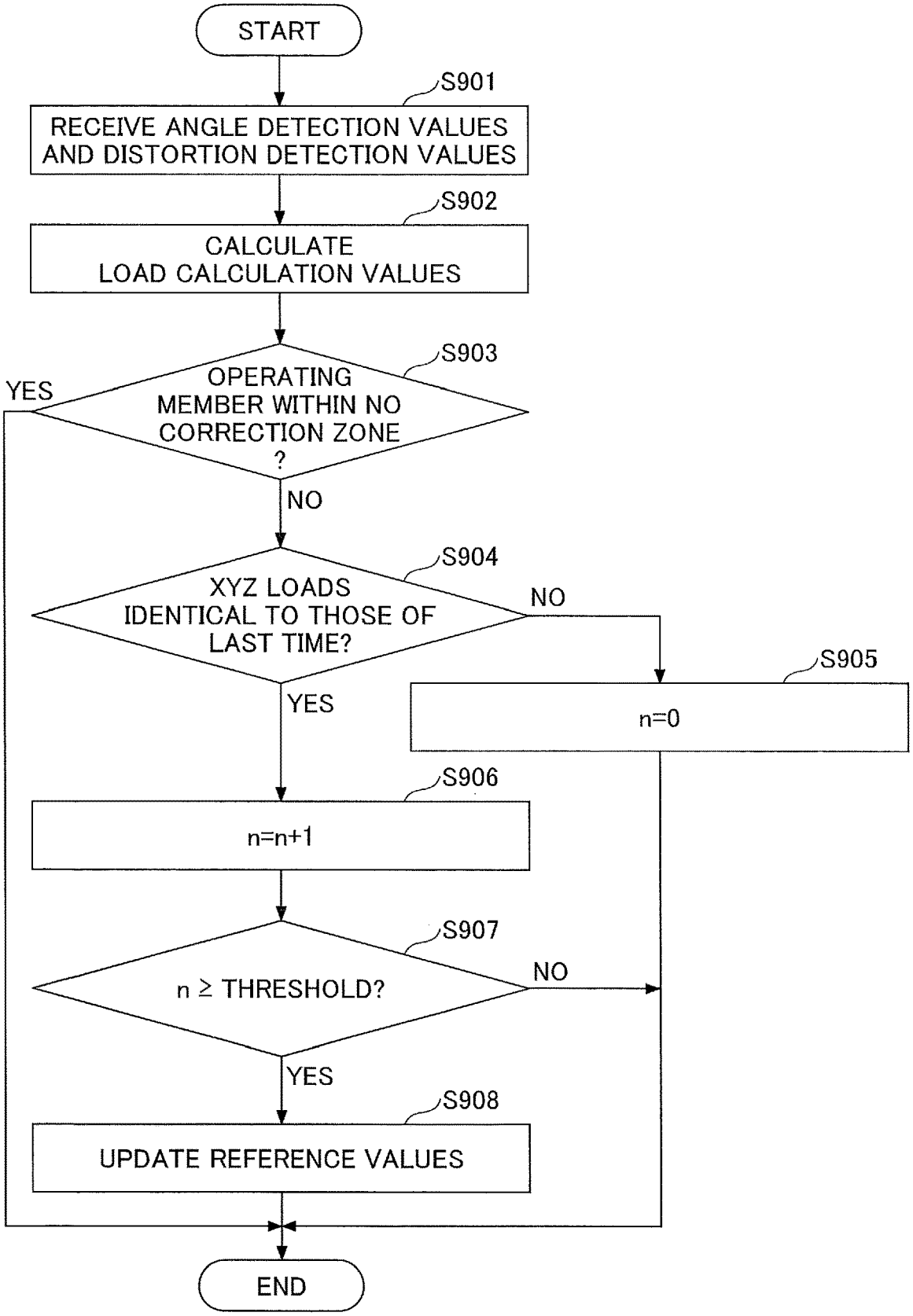
FIG. 9 is a flowchart illustrating an example (third example) of a process executed by the controller according to the embodiment.

Next, an example (third example) of a process executed by the controller 150 is described. FIG. 9 is a flowchart illustrating an example (third example) of a process executed by the controller 150 according to the embodiment. Here, an example where the controller 150 corrects the reference values (origin in unloaded state) of the load detector 130 is described.

First, at step S901, the controller 150 receives the angle detection values d1 and d2 and the distortion detection values d3, d4, d5, and d6.

Next, at step S902, the controller 150 calculates the load calculation value in the X axis direction, the Y axis direction, and the Z axis direction based on the distortion detection values d3, d4, d5, and d6 received at step S901.

Next, at step S903, the controller 150 determines whether the tilt angle of the operating member 220 is within a predetermined no correction zone (where correction is forbidden; see FIG. 10) based on the angle detection values d1 and d2 received at step S901.

In response to determining at step S903 that the tilt angle of the operating member 220 is within a predetermined no correction zone (YES at step S903), the controller 150 ends the series of processes illustrated in FIG. 9.

In response to determining at step S903 that the tilt angle of the operating member 220 is not within a predetermined no correction zone (NO at step S903), at step S904, the controller 150 determines whether the load calculation values in the X axis direction, the Y axis direction, and the Z axis direction calculated at step S902 are identical to the load calculation values calculated in the last process. Here, values within a predetermined error range are considered as identical.

In response to determining at step S904 that the load calculation values calculated at step S902 are not identical to the load calculation values calculated in the last process (NO at step S904), at step S905, the controller 150 sets a variable n to "0." Then, the controller 150 ends the series of processes illustrated in FIG. 9.

In response to determining at step S904 that the load calculation values calculated at step S902 are identical to the load calculation values calculated in the last process (YES at step S904), at step S906, the controller 150 adds "1" to the variable n. Then, at step S907, the controller 150 determines whether the variable n is more than or equal to a predetermined threshold.

In response to determining at step S907 that the variable n is not more than or equal to a predetermined threshold (NO at step S907), the controller 150 ends the series of processes illustrated in FIG. 9.

In response to determining at step S907 that the variable n is more than or equal to a predetermined threshold (YES at step S907), at step S908, the controller 150 updates the reference values (origin in unloaded state) of the load detector 130 to the values of the distortion detection values d3, d4, d5, and d6 received at step S901. Then, the controller 150 ends the series of processes illustrated in FIG. 9.

According to the series of processes illustrated in FIG. 9, even when the load calculation values are other than "0," the controller 150 can update the reference values of the load detector 130 using the load calculation values at the time if the load calculation values remain unchanged for a certain period of time. Therefore, for example, in the case where the multidirectional input device 10 is inclined relative to a horizontal plane, even when a load applied from the operating member 220 is detected despite the absence of a user's operation, the controller 150 can update the reference values of the load detector 130 using the load calculation values at the time.

Furthermore, even when the load calculation values remain unchanged for a certain period of time, the controller 150 can prevent the reference values of the load detector 130 from being updated if the tilt angle of the operating member 220 is within a predetermined no correction zone. This enables the controller 150 to prevent erroneous updating of the reference values of the load detector 130.

The updated reference values are stored in a memory of the controller 150. From that point, the controller 150 calculates a load applied to the multidirectional input device 10 using the reference values stored in the memory. Specifically, the controller 150 defines a value calculated according to a formula (detection value−reference value) as a variation in voltage value due to a load applied to the multidirectional input device 10 with respect to each of the distortion detection values d3, d4, d5, and d6, and calculates the load based on the variations.

Figure 10:
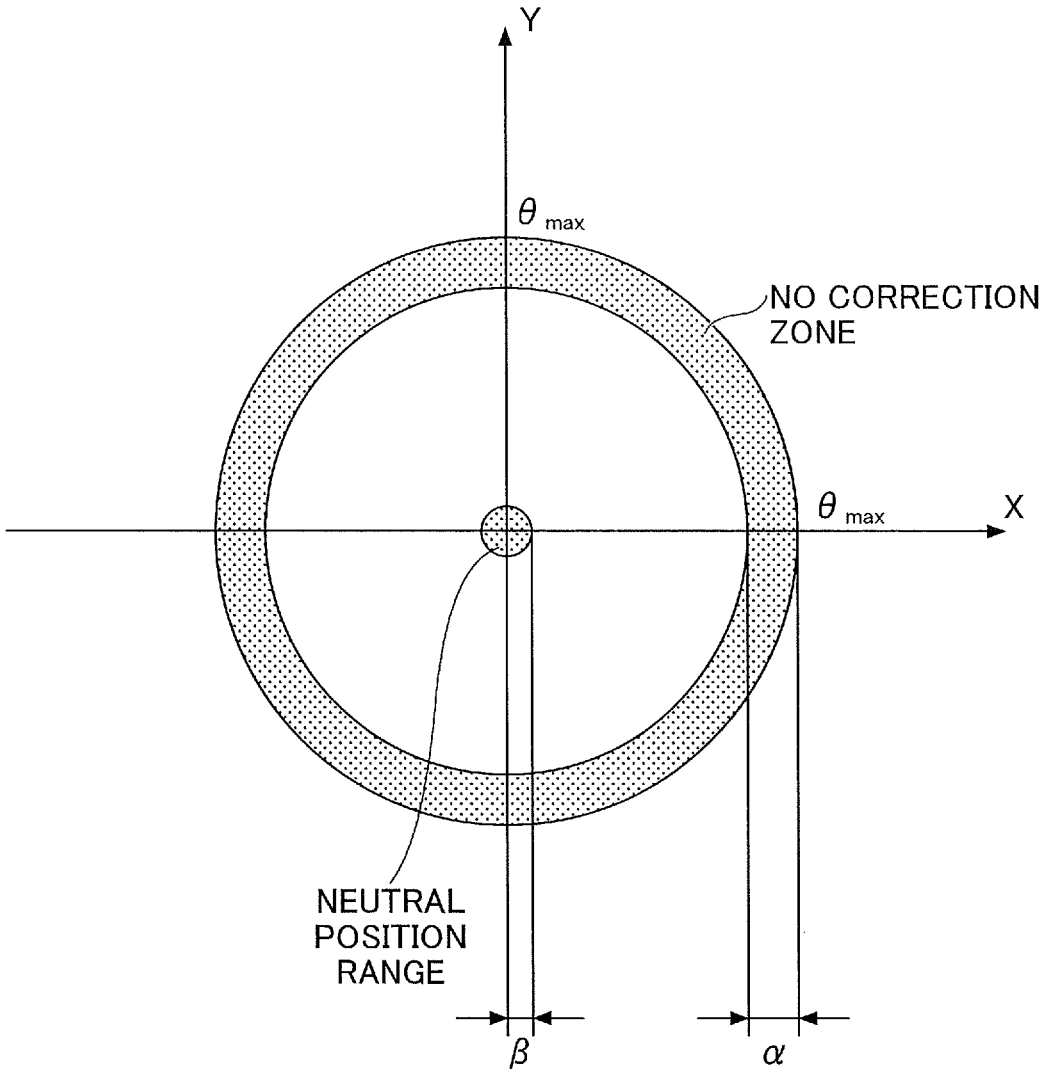
FIG. 10 is a diagram illustrating an example of a no correction zone in the multidirectional input device according to the embodiment.

Next, an example of the no correction zone and the neutral position range is described. FIG. 10 is a diagram illustrating an example of the no correction zone and the neutral position range in the multidirectional input device 10 according to the embodiment.

Referring to FIG. 10, according to the embodiment, regarding the tilt of the operating member 220, a zone including a predetermined margin of error α from a movement limit angle θmax is set as the "no correction zone" with respect to each of the X axis direction and the Y axis direction. The movement limit angle θmax is an angle corresponding to the movement limit position of the operating member 220.

As described with reference to FIG. 9, the controller 150 according to the embodiment can prevent the reference values of the load detector 130 from being updated even when the load calculation values remain unchanged for a certain period of time while the tilt angle of the operating member 220 is within the no correction zone. This enables the controller 150 to prevent erroneous updating of the reference values of the load detector 130. When the tilt angle of the operating member 220 is the movement limit angle θmax, the operator can easily apply a certain load to the operating member 220, taking advantage of the operating member 220 being physically restricted from further tilting. Therefore, the controller 150 according to this embodiment does not update the reference values of the load detector 130 when the tilt angle of the operating member 220 is close or equal to the movement limit angle θmax.

According to this embodiment, the tilt angle of the operating member 220 when the operating member 220 contacts the edge of the circular opening 211A formed in the center of the top of the case 210 is set as the movement limit angle θmax. Therefore, according to this embodiment, the movement limit angle θmax in the X axis direction and the movement limit angle θmax in the Y axis direction are equal to each other. The movement limit angle θmax in the X axis direction and the movement limit angle θmax in the Y axis direction, however, may be different from each other.

Furthermore, referring to FIG. 10, according to this embodiment, regarding the tilt of the operating member 220, a range including a predetermined margin of error β from 0° is set as the "neutral position range" with respect to each of the X axis direction and the Y axis direction. It is preferable to update the reference values of the load detector 130 when the operating member 220 is not operated. Therefore, the margin of error β may be set to a relatively large value to cause the reference values of the load detector 130 to be more likely to be updated, and the reference values of the load detector 130 may be prevented from being updated when the tilt angle of the operating member 220 is outside the neutral position range.

As described with reference to FIGS. 7 and 8, according to this embodiment, when the tilt of the operating member 220 is within the neutral position range, "0" may be output as the output value of the tilt angle of the operating member 220 in each of the X axis direction and the Y axis direction.

Furthermore, according to this embodiment, when the tilt of the operating member 220 is within the neutral position range, "0" may be output as the load output value in the Z axis direction if the load calculation value in the Z axis direction is less than a predetermined threshold and the load calculation value in the Z axis direction may be output as the load output value in the Z axis direction if the load calculation value in the Z axis direction is more than or equal to a predetermined threshold.

As described above, according to the multidirectional input device 10 of the embodiment, if the load detection values detected by the load detector 130 are less than predetermined thresholds, the controller 150 may output no output signal or may output an output signal that sets the magnitude of a user's operation to "0."

Accordingly, the multidirectional input device 10 according to the embodiment can prevent erroneous detection of a user's operation on the operating member 220 when the operating member 220 is slightly tilted because of the tilt of the multidirectional input device 10 or the like; although the operating member 220 is not operated by the user.

Furthermore, according to the multidirectional input device 10 of the embodiment, the controller 150 may output an output signal that sets the magnitude of a user's downward operation on the operating member 220 as a load detection value when the tilt of the operating member 220 is within a predetermined neutral position range and the downward load detection value detected by the load detector 130 is more than or equal to a predetermined threshold, and may output an output signal that sets the magnitude of a user's downward operation on the operating member 220 to "0" when the tilt of the operating member 220 is within a predetermined neutral position range and the downward load detection value detected by the load detector 130 is less than a predetermined threshold.

Accordingly, when the operating member 220 is pushed downward, the multidirectional input device 10 of this embodiment makes it possible for the output target device to detect the pushing. Furthermore, the multidirectional input device 10 can prevent erroneous detection of a load in the Z axis direction caused by error due to the self-weight of the operating member 220, error due to noise, or the like while the operating member 220 is not operated.

Furthermore, according to the multidirectional input device 10 of the embodiment, the controller 150 may include angle output values based on angle detection values in the output signal when the tilt of the operating member 220 is at a position other than a movement limit position, and may include angle output values based on load detection values in the output signal when the tilt of the operating member 220 is at the movement limit position.

Accordingly, when the operating member 220 is further pushed with the tilt angle of the operating member 220 being a movement limit angle, the multidirectional input device 10 of this embodiment can output angle output values that represent the virtual tilt angles (tilt angles exceeding physical tilt angles) of the operating member 220 according to a load applied to the multidirectional input device 10 by this further pushing.

Furthermore, according to the multidirectional input device 10 of this embodiment, the controller 150 includes the correction part 153. When the tilt of the operating member 220 remains unchanged for a certain period of time, the correction part 153 corrects the reference values of the load detector 130 based on the detection values of the load detector 130 at the time unless the tilt of the operating member 220 is within a predetermined no correction zone.

Furthermore, even when the tilt of the operating member 220 remains unchanged for a certain period of time, the multidirectional input device 10 according to this embodiment may prevent updating of the reference values of the load detector 130 if the tilt angle of the operating member 220 is within a predetermined no correction zone. This enables the controller 150 to prevent erroneous updating of the reference values of the load detector 130.

An embodiment of the present invention is described above. The present invention, however, is not limited to the above-described embodiment, and variations and modifications may be made without departing from the scope of the present invention.

For example, the "predetermined no correction zone" may be, but is not limited to, a zone including the movement limit position of an operating member as illustrated in the above-described embodiment. For example, the "predetermined no correction zone" may be a zone excluding a zone including the neutral position of the operating member (namely, the "neutral position range").

Furthermore, the "tilt detectors" may be, but are not limited to, the two rotation sensors 118 and 119 as illustrated in the above-described embodiment. For example, a single GMR device that can detect the tilt angle of the operating member 220 in each of the X axis direction and the Y axis direction may be used as the "tilt detectors."

Furthermore, according to the above-described embodiment, the load calculation value in the Z axis direction output by the controller 150 numerically expresses the magnitude of a load in the Z axis direction. The form of expression of the load calculation value in the Z axis direction, however, is not limited to this. For example, the load calculation value in the Z axis direction output by the controller 150 may be a binary value (ON and OFF). This enables the operating member 220 of the multidirectional input device 10 to operate as a push-button for switching ON and OFF states.

Furthermore, according to the above-described embodiment, the controller 150 may correct parameters used in angle calculation formulae such that the angle detection values d1 and d2 detected by the rotation sensors 118 and 119 match the angle calculation values calculated by the angle calculating part 152 when the tilt of the operating member 220 reaches a movement limit position. This can maintain high accuracy in calculating angle calculation values according to the angle calculation formulae.

Furthermore, for example, a load applied to the case 210 is detected using distortion sensors provided below the case 210 according to the above-described embodiment. The configuration for detecting a load applied to the case 210, however, is not limited to this, and a load applied to the case 210 may also be detected using pressure sensors provided below the case 210.

Furthermore, for example, four distortion sensors are arranged around the columnar part 121 according to the above-described embodiment. The arrangement of distortion sensors, however, is not limited to this, and three or less or five or more distortion sensors may be arranged around the columnar part 121.

Furthermore, for example, the load detector 130 is placed on the base 120 according to the above-described embodiment. The placement of the load detector 130, however, is not limited to this, and the load detector 130 may be provided at the bottom of the case 210.

Furthermore, for example, the four coil springs 114*a*, 114*b*, 114*c*, and 114*d*, which are vertically elastically deformable and placed in four directions with respect to the central axis AX of the operating member 220, are used as an example of the "returning part" for returning the operating member 220 to neutral state according to the above-described embodiment. The "returning part," however, is not limited to this. For example, as another example of the "returning part," multiple coil springs that are horizontally elastically deformable to urge the pivot shafts of the two coupled parts via respective levers to pivot in a returning direction may also be used. In this case as well, a load in horizontal directions (the X axis direction and the Y axis direction) input from the operating member 220 is less likely to be converted into a force in a vertical direction (the Z axis direction). Therefore, it is possible to improve the accuracy of detecting a load in horizontal directions.

What is claimed is:

1. A multidirectional input device comprising:

an operation input part including an operation stick configured to be tilted in a horizontal direction by an operation on the operation stick;

a tilt detector configured to detect an angle detection value representing a tilt direction and a tilt angle of the operation stick;

a returning part configured to return the operation stick to neutral state; and a frame storing the tilt detector, the returning part, and a part of the operation stick;

a base having a plate shape and provided below the frame;

a load detector provided on the frame or the base and configured to detect a load detection value representing a direction and magnitude of a load applied to the frame; and circuitry configured to output an output signal representing a direction and magnitude of the operation on the operation stick, based on the angle detection value detected by the tilt detector and the load detection value detected by the load detector, wherein the circuitry is configured to correct a reference value of the load detector based on a detection value of the load detector unless a tilt of the operation stick is within a predetermined no correction zone, when the tilt of the operation stick remains unchanged for a certain period of time.

2. The multidirectional input device as claimed in claim 1, wherein the predetermined no correction zone includes a movement limit position of the tilt of the operation stick.

3. The multidirectional input device as claimed in claim 1, wherein the predetermined no correction zone excludes a zone including a neutral position of the operation stick.

* * * * *